US007841822B2

(12) United States Patent
Tygard

(10) Patent No.: US 7,841,822 B2
(45) Date of Patent: Nov. 30, 2010

(54) MANIPULATOR FOR A LIFT TRUCK

(75) Inventor: Edward Tygard, McMurray, PA (US)

(73) Assignee: Tygard Machine & Manufacturing Company, Washington, PA (US)

( * ) Notice: Subject to any disclaimer, the term of this patent is extended or adjusted under 35 U.S.C. 154(b) by 1147 days.

(21) Appl. No.: 11/483,188

(22) Filed: Jul. 10, 2006

(65) Prior Publication Data

US 2007/0014655 A1 Jan. 18, 2007

Related U.S. Application Data

(60) Provisional application No. 60/699,379, filed on Jul. 15, 2005.

(51) Int. Cl.
*B66F 9/18* (2006.01)

(52) U.S. Cl. ..... 414/623; 414/633; 414/637; 414/659; 414/660; 414/800

(58) Field of Classification Search ..... 414/352, 414/633, 637, 659, 660, 623, 800
See application file for complete search history.

(56) References Cited

U.S. PATENT DOCUMENTS 2,646,182 A * 7/1953 Maas ..... 414/637
2,753,066 A * 7/1956 Arnot ..... 414/633
3,272,365 A * 9/1966 Stevens ..... 414/633
3,907,140 A * 9/1975 Jinks ..... 414/633
4,690,609 A * 9/1987 Brown ..... 414/543
5,516,255 A * 5/1996 Tygard ..... 414/607
6,003,917 A * 12/1999 Tygard ..... 294/87.1
6,135,704 A 10/2000 Seaberg ..... 414/791.6
7,195,105 B2 * 3/2007 Tygard ..... 187/238
7,537,427 B2 * 5/2009 Tygard ..... 414/623
2006/0169540 A1 * 8/2006 Tygard ..... 187/222

FOREIGN PATENT DOCUMENTS

JP 05254790 * 10/1993

* cited by examiner

*Primary Examiner*—Michael S Lowe
(74) *Attorney, Agent, or Firm*—Michael Tobias

(57) ABSTRACT

A manipulator for use with a lift truck includes a guide assembly mountable on a mast of a lift truck, a carriage assembly supported for movement along the guide assembly, and an arm assembly mounted on the carriage assembly for supporting a lift truck attachment such as a clamping apparatus. The arm assembly may include two arms pivotable with respect to each other about a substantially vertical axis. The manipulator can move a load in a widthwise direction of a lift truck and between opposite widthwise sides of a lift truck.

18 Claims, 14 Drawing Sheets

MANIPULATOR FOR A LIFT TRUCK

This application claims the priority of U.S. Provisional Application No. 60/699,379 filed on Jul. 15, 2005, the disclosure of which is incorporated by reference.

BACKGROUND OF THE INVENTION

This invention relates to a manipulator for use with a lift truck attachment which enables the attachment to access a load located on either widthwise side of the lift truck.

A lift truck is a self-propelled vehicle equipped with a movable, frame, referred to as a carriage, which can be raised and lowered along an upright mast. Various attachments, such as forks or clamps for supporting or grasping a load, can be mounted on the carriage so that the lift truck can raise and lower the load.

A typical lift truck is designed so that a load being supported, transported, or otherwise handled by the lift truck is disposed directly in front of the lift truck. However, in some situations, it is desirable for a lift truck to be able to grasp a load located to a widthwise side of the lift truck. For example, in factories and warehouses, merchandise is often stored on shelves or in rows of pallets separated by an aisle. If a lift truck situated in such an aisle is capable of grasping merchandise located on a widthwise side of the lift truck instead of the lift truck having to be turned within the aisle so as to directly face the merchandise, the lift truck can be operated in a narrow aisle only slightly wider than the width of the lift truck, thus enabling more merchandise to be accommodated in a given floor area.

SUMMARY OF THE INVENTION

The present invention provides a manipulator for use with a lift truck which can support a lift truck attachment so as to be able to grasp a load located on either widthwise side of the lift truck.

The present invention also provides a manipulator for use with a lift truck which can change the orientation of a load while operating within a narrow space.

The present invention also provides a lift truck equipped with such a manipulator.

The present invention additionally provides a method of operating a lift truck equipped with such a manipulator.

According to one form of the present invention, a manipulator for manipulating a lift truck attachment includes a guide assembly which can be mounted on a mast of a lift truck so as to extend in a widthwise direction of the lift truck. A carriage assembly is supported by the guide assembly for movement along the guide assembly, and an arm assembly has a first arm connected to the carriage assembly and a second arm connectable to an attachment for a lift truck and rotatably connected to the first arm. Preferably the second arm is capable of being rotated with respect to the first arm by at least approximately 180° to enable a load to be transferred between opposite widthwise sides of the lift truck.

Preferably the carriage assembly can move along the guide assembly by at least 40 inches to enable a load to be transferred between two standard pallets disposed side by side.

The manipulator is not restricted to any particular use, but typically is it mounted on a mast for a lift truck such that the manipulator can be raised and lowered along the mast. The manipulator can be used with a wide variety of lift truck attachments. In preferred embodiments, the manipulator is used to support a clamping apparatus for grasping a load from two or more sides.

According to another form of the present invention, a method of operating a lift truck includes moving a load held by a clamping apparatus between opposite widthwise sides of a lift truck using a manipulator according to the present invention.

According to still another form of the present invention, a method of moving a load includes transferring a load from a first pallet to a second pallet using a manipulator according to the present invention mounted on a lift truck without changing the location of the mast of the lift truck.

It is common for lift trucks to be equipped with a device referred to as a sideshifter for translating the forks of the lift truck from side to side in the widthwise direction of the lift truck. However, a sideshifter has a very limited range of movement, and is primarily intended for carrying out fine adjustment of the widthwise position of the forks of the lift truck, such as when aligning the forks with openings in a pallet, and it is not capable of performing any substantial movement of a load in the widthwise direction of the lift truck.

In contrast, a manipulator according to the present invention is capable of extensive movement of a load in the widthwise direction of a lift truck, enabling it to perform tasks such as transferring a load from one pallet to another or moving a load between opposite widthwise sides of the lift truck. Therefore, it provides a whole different range of uses not possible with a sideshifter.

DESCRIPTION OF PREFERRED EMBODIMENTS

Figure 1:
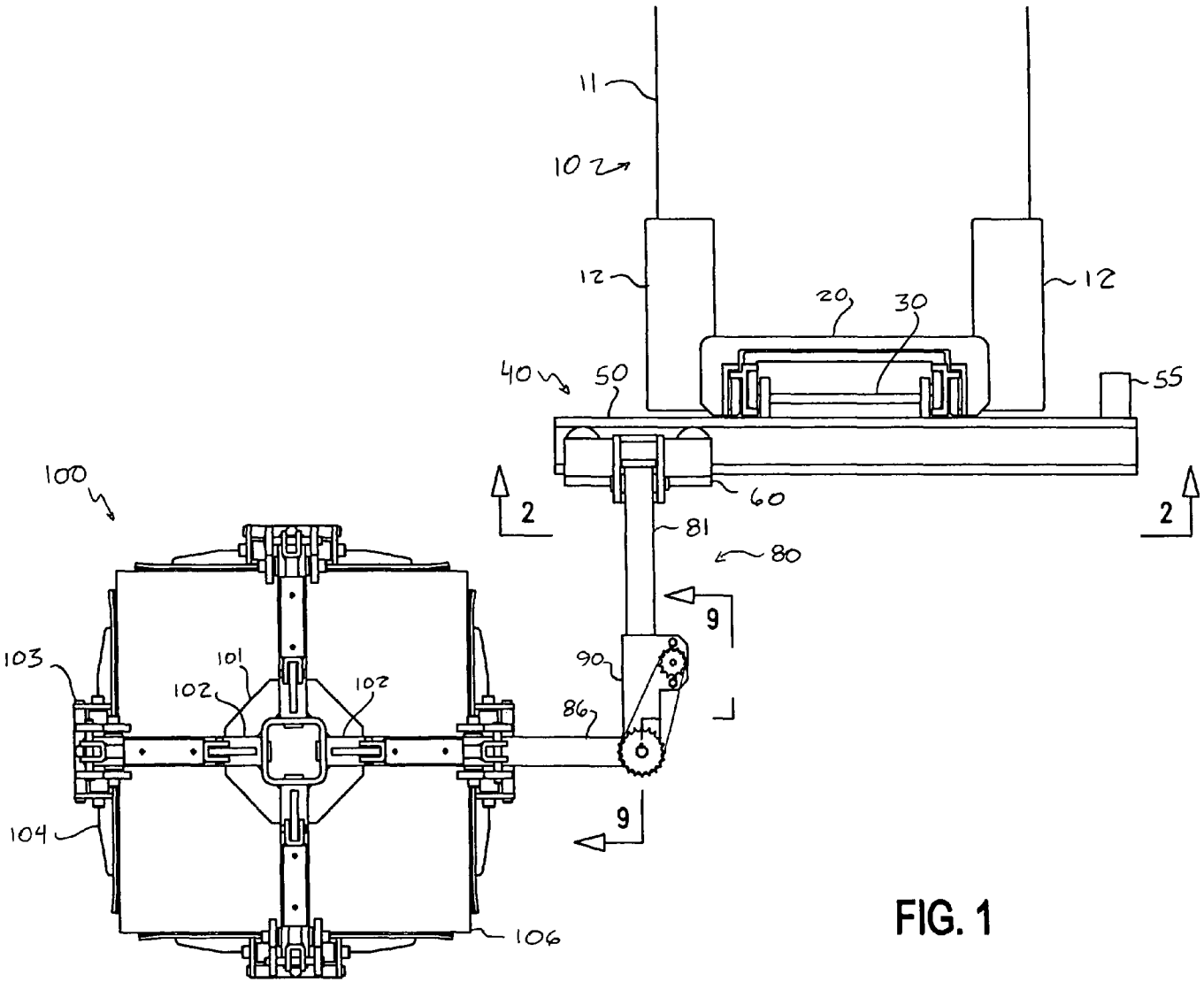
FIG. 1 is a schematic plan view of a lift truck equipped with an embodiment of a manipulator according to the present invention supporting a clamping apparatus.

An embodiment of a manipulator for a lift truck according to the present invention will be described while referring to the accompanying drawings. FIG. 1 is a schematic plan view of the manipulator 40 mounted on a lift truck 10 and supporting a lift truck attachment in the form of a clamping apparatus 100 for grasping a load 106 from two or more sides. As shown in this figure, the manipulator 40 includes a guide assembly 50 mounted on the lift truck 10, a carriage assembly 60 supported by the guide assembly 50 for horizontal movement in the widthwise direction of the lift truck 10, and an arm assembly 80 supported by the carriage assembly 60 and connected to the clamping apparatus 100.

Figure 2:
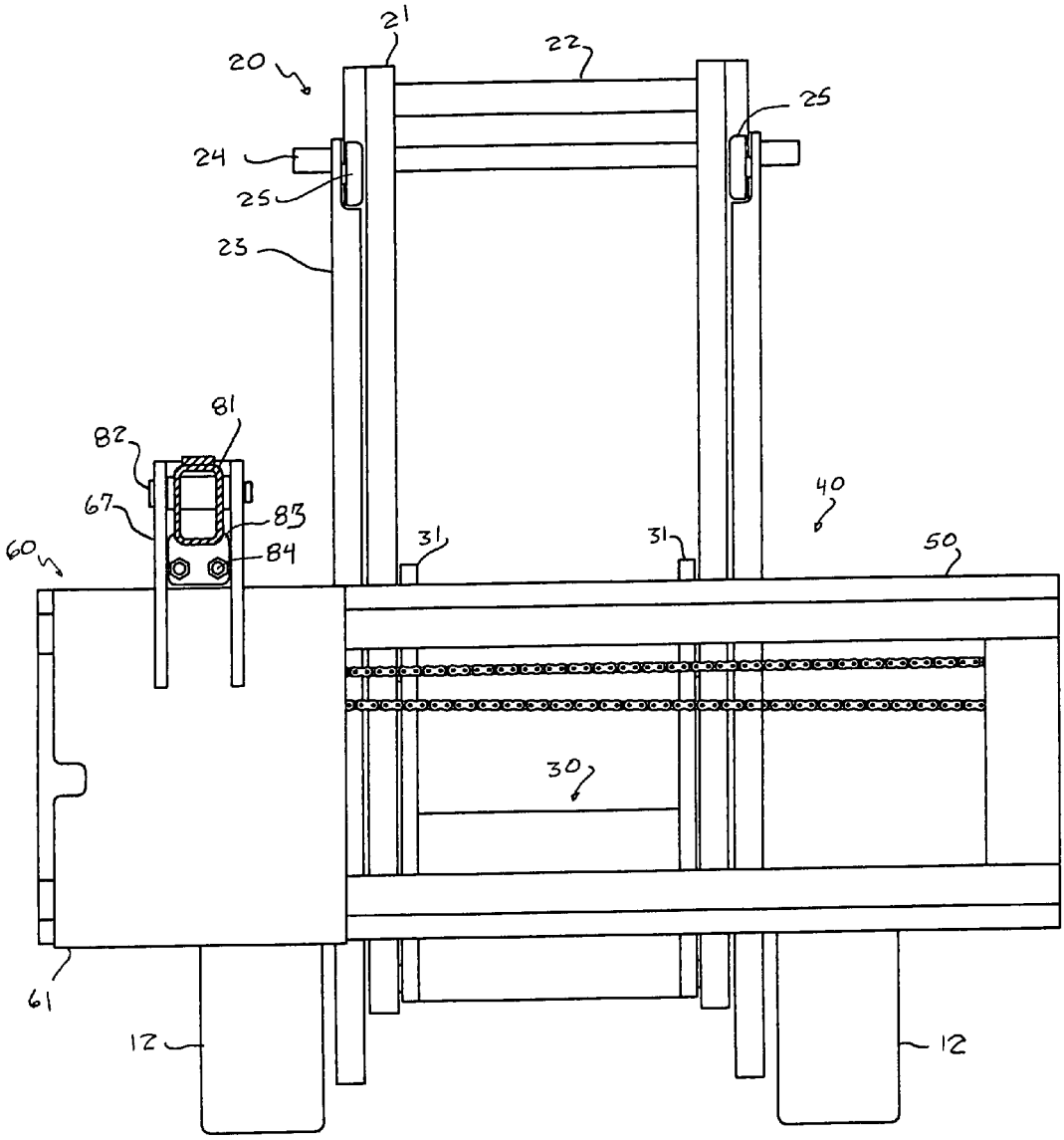
FIG. 2 is a schematic cross-sectional elevation of the lift truck and manipulator of FIG. 1 taken along line 2-2 of FIG. 1.

The lift truck 10 may have any structure enabling it to support and transport a load. For example, it may be selected from a wide variety of commercially available lift trucks. The illustrated lift truck 10 includes a body 11 supported by a plurality of wheels 12 (four in the present embodiment). A mast 20 is mounted on the front of the body 11 in a conventional manner so that the mast 20 can be tilted forward and backward with respect to the body 11 to adjust the angle of the mast 20 with respect to the vertical, and a carriage 30 is supported by the mast 20 for vertical movement along the mast 20. The illustrated mast 20 is what is commonly referred to as a two-stage mast, but it may instead be a one-stage mast or a mast with three or more stages. The structure of the mast 20 may be conventional. As best shown in FIG. 2, which is a schematic cross-sectional elevation taken along line 2-2 of FIG. 1, the mast 20 includes a pair of inner channels 21, which are uprights disposed in parallel on opposite widthwise sides of the mast 20, and a pair of outer channels 23, which are uprights disposed in parallel on opposite widthwise sides of the inner channels 21. The inner channels 21 are connected to each other at their upper ends by a crosspiece 22 extending in the widthwise direction of the mast 20 on the rear side of the inner channels 21, and the outer channels 23 are connected with each other by a crosspiece 24 extending in the widthwise direction of the mast 20 to the rear of crosspiece 22. Additional unillustrated crosspieces for the inner channels 21 and outer channels 23 are disposed lower down on the mast 20. Rollers 25 are provided at the upper ends of the outer channels 23 for rolling contact with flanges of the inner channels 21, and unillustrated rollers are mounted near the lower end of the inner channels 21 for rolling contact with the interior of the outer channels 23 as the inner channels 21 are raised and lowered along the outer channels 23. The carriage 30 can be raised and lowered with respect to the inner channels 21 and the inner channels 21 can be raised and lowered with respect to the outer channels 23 by a conventional unillustrated lifting mechanism, which typically employs hydraulic cylinders which raise and lower the inner channels 21 with respect to the outer channels 23, and a chain and pulley system which raises and lowers the carriage 30 along the inner channels 21 as the inner channels 21 are raised and lowered along the outer channels 23. However, any other suitable type of lifting mechanism may instead be employed. As described in U.S. patent application Ser. No. 11/153,899 entitled "Lift Truck", the disclosure of which is incorporated by reference, guide rollers may be provided at the upper and lower ends of the mast 20 to maintain the inner channels 21 parallel to the outer channels 23. The mast 20 may also include a guide arrangement for resisting lateral forces and moments acting on the carriage 30 of the mast 20 about an axis extending in the fore-and-aft direction of the lift truck 10. Various examples of suitable guide arrangements are also described in the above-mentioned U.S. patent application Ser. No. 11/153,899.

The lift truck attachment which is supported by the arm assembly 80 may be any type of attachment adapted for mounting on a lift truck, such as an attachment for lifting, grasping, or otherwise manipulating a load. Some examples of attachments which can be employed are forks and various types of clamps. In the present embodiment, the attachment comprises a clamping apparatus 100 capable of grasping a load 106 from two or more sides. The structure of the illustrated clamping apparatus 100 is described in detail in U.S. patent application Ser. No. 10/689,848 entitled "Clamping Apparatus", the disclosure of which is incorporated by reference, so it will be described only briefly here.

The clamping apparatus 100 includes a cross-shaped frame 101 having four legs 102 on which are mounted a plurality of clamping arms 103 capable of pivoting with respect to the frame 101 to grasp and release a load 106. At its lower end, each clamping arm 103 is equipped with a contact portion 104 for contacting the side of a load 106. The clamping arms 103 can be pivoted on the frame 101 by suitable actuators, such as hydraulic cylinders 105.

Figure 3:
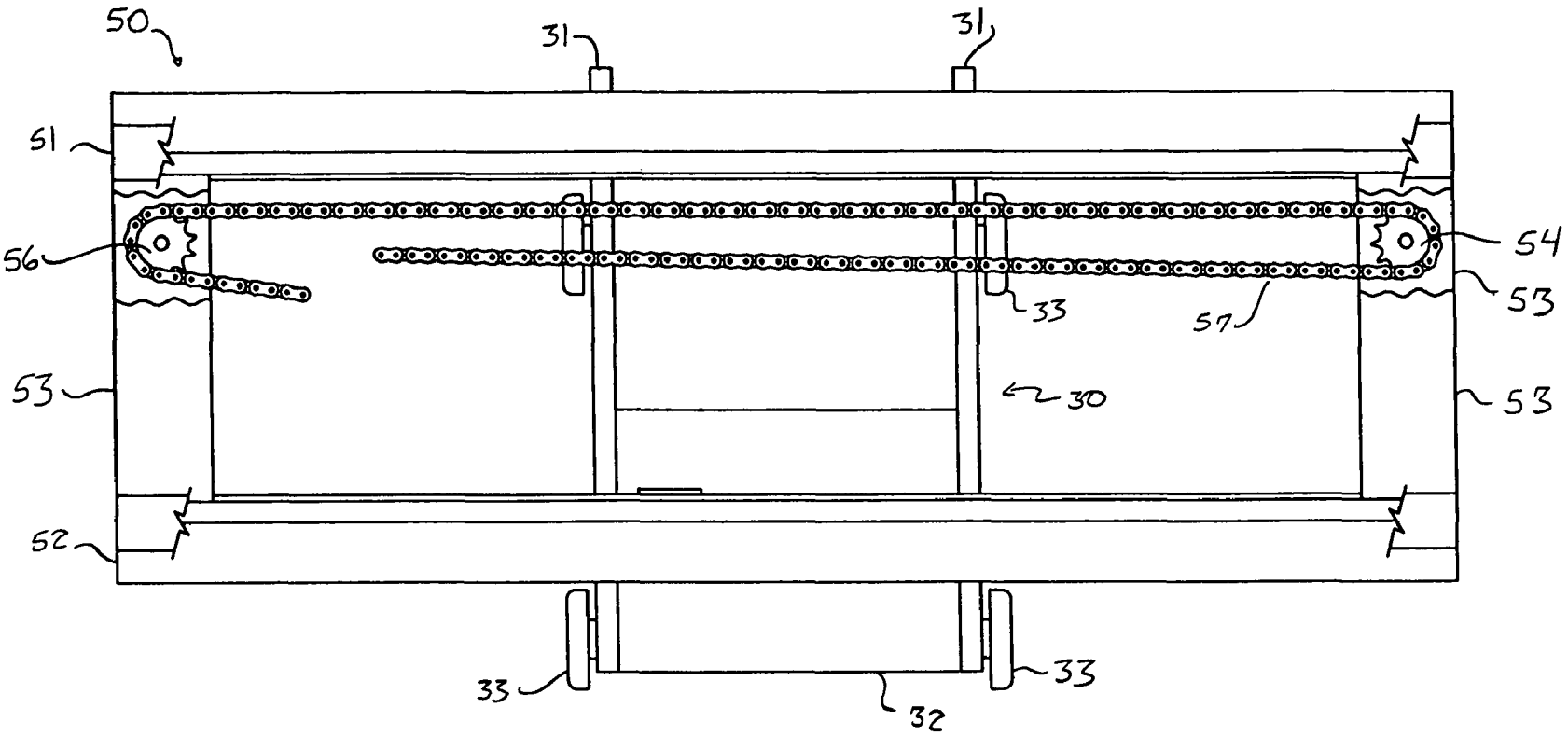
FIG. 3 is a schematic cutaway front elevation of the guide assembly of the manipulator of FIG. 2 and the lift truck carriage removed from the mast of the lift truck.
Figure 4:
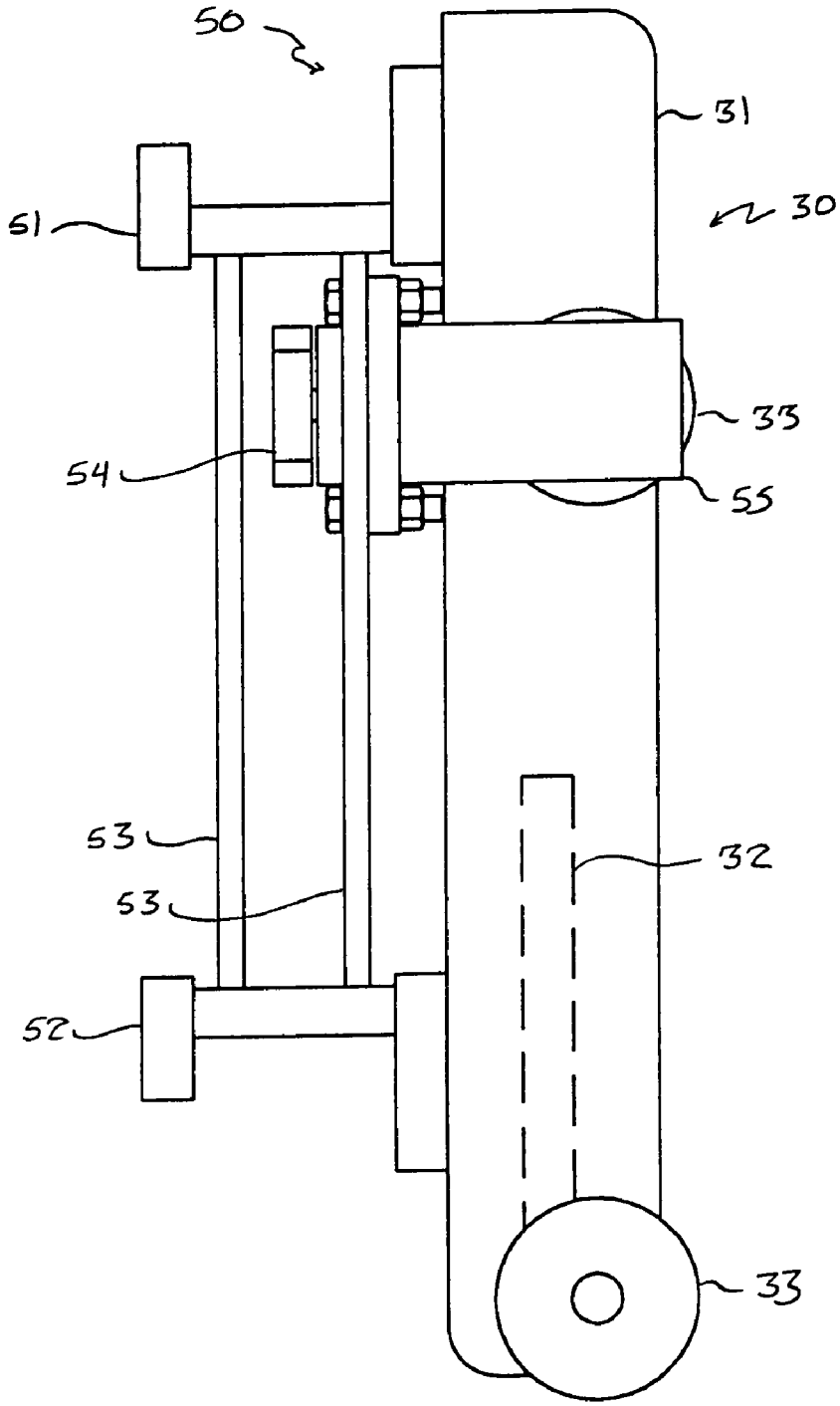
FIG. 4 is a schematic side elevation of the guide assembly and the lift truck carriage of FIG. 3.

The guide assembly 50 supports the carriage assembly 60 for movement in the widthwise direction of the lift truck 10 while supporting the weight of the carriage assembly 60, the arm assembly 80, the clamping apparatus 100, and any load 106 grasped by the clamping apparatus 100. In the present embodiment, the guide assembly 50 includes a plurality of guide rails, and the carriage assembly 60 includes rollers which can roll along the guide rails of the guide assembly 50. However, the guide assembly 50 may support the carriage assembly 60 in a different manner, such as for sliding movement. As shown in FIGS. 3 and 4, which are a schematic cutaway front elevation and a schematic side elevation of the guide assembly 50 of the manipulator 40 and the lift truck carriage 30 removed from the mast 20 of the lift truck 10, the guide assembly 50 includes an upper guide rail 51 and a lower guide rail 52 extending parallel to each other in the widthwise direction of the lift truck 10. Each of the guide rails 51 and 52 includes a pair of vertical metal plates opposing each other and connected with each other by a horizontal metal plate. Alternatively, instead of comprising a plurality of plates joined to each other, each guide rail 51 and 52 may be a one-piece member, such as an I-beam or a channel. The upper and lower guide rails 51 and 52 are joined to each other at opposite ends of the guide assembly 50 by vertical connecting plates 53.

The guide assembly 50 is preferably capable of being raised and lowered by the lift truck 10 to adjust the height of a load 106 supported by the manipulator 40. The guide assembly 50 may be detachably mounted on the carriage 30 of the lift truck 10. For example, the upper and lower guide rails 51 and 52 may be equipped with fittings for detachable engagement with the horizontal mounting bars of a typical lift truck carriage. Alternatively, as in this embodiment, the guide assembly 50 may be integrated with the lift truck carriage 30 so as to form a single unit. As shown in FIG. 3, the illustrated lift truck carriage 30 includes a pair of vertical side plates 31 secured to each other by a connecting plate 32 extending in the widthwise direction of the lift truck 10. Each of the side plates 31 is equipped with two rollers 33 which can roll along the interiors of the inner channels 21 of the mast 20 to guide the carriage 30 as it moves along the mast 20. In place of the mounting bars which would normally be secured to the front sides of the side plates 31 in a typical lift truck carriage, in this embodiment, the upper and lower guide rails 51 and 52 are secured to the front sides of the side plates 31 by welding, for example.

Figure 5:
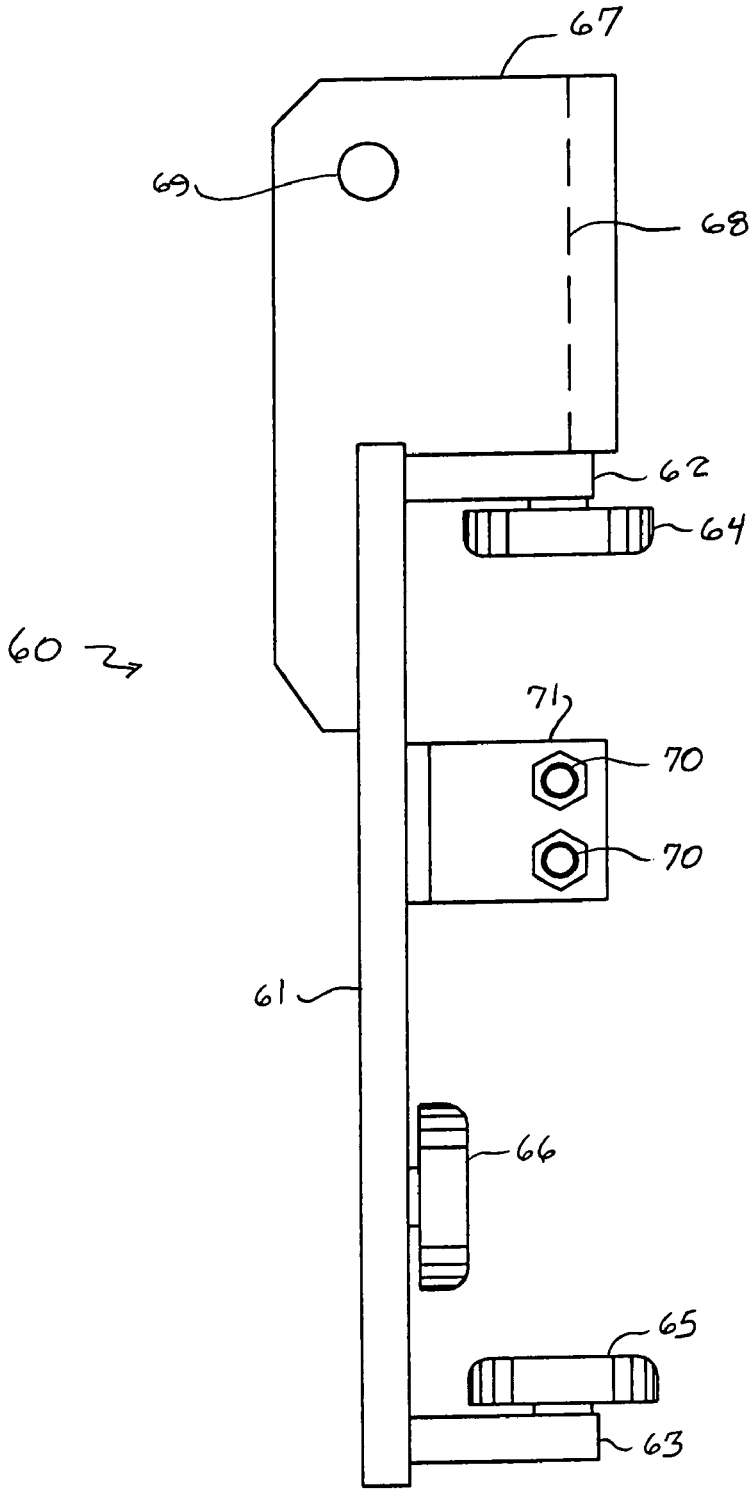
FIG. 5 is a schematic side elevation of the carriage assembly of FIG. 2 removed from the guide assembly.
Figure 6:
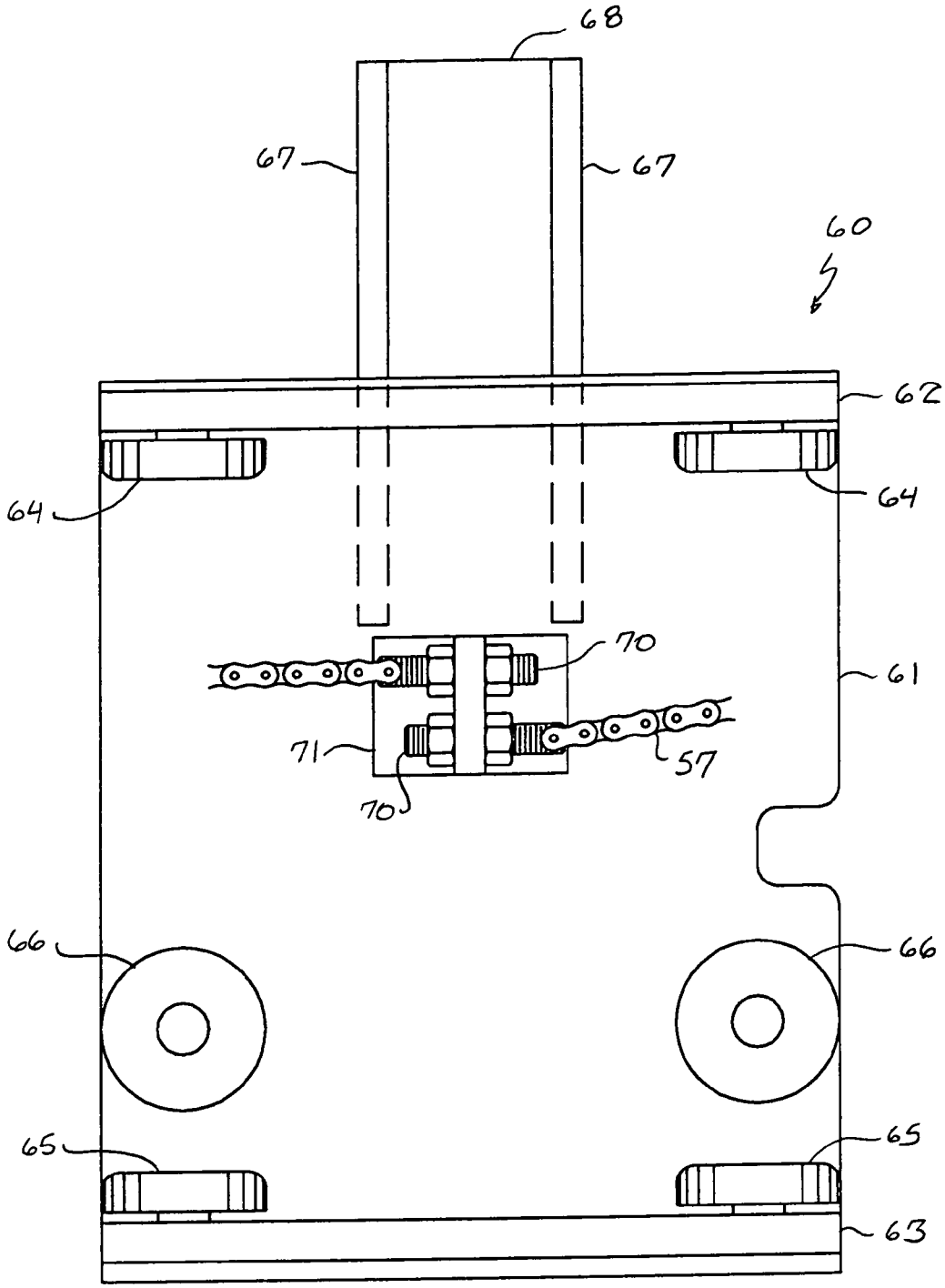
FIG. 6 is a schematic rear elevation of the carriage assembly of FIG. 5.
Figure 7:
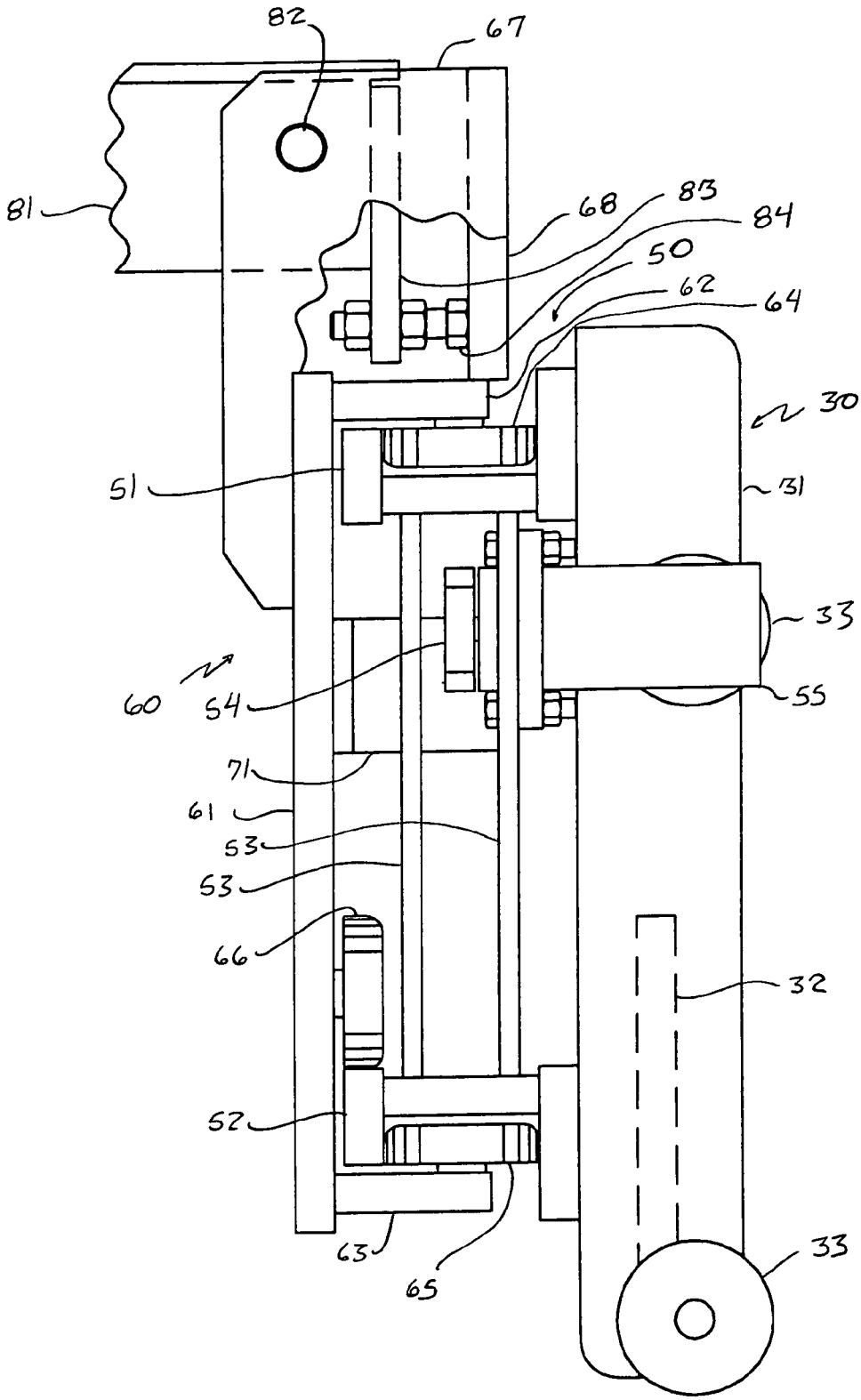
FIG. 7 is a schematic side elevation of the carriage assembly of FIG. 5 mounted on the guide assembly of FIG. 4.

As shown in FIGS. 5 and 6, which are respectively a schematic side elevation and a schematic rear elevation of the carriage assembly 60 of FIG. 2 removed from the guide assembly 50, the carriage assembly 60 includes a vertical front plate 61 and upper and lower horizontal support plates 62 and 63 secured to the back side of the front plate 61. The upper support plate 62 rotatably supports a pair of upper rollers 64, and the lower support plate rotatably supports a pair of lower rollers 65. A pair of middle rollers 66 is rotatably supported on the back side of the front plate 61. Rollers 64 and 65 each have a rotational axis which is vertical when the support plates 62 and 63 are horizontal, and rollers 66 each have a rotational axis which is horizontal when the support plates 62 and 63 are horizontal. As shown in the schematic side elevation of FIG. 7, when the carriage assembly 60 is mounted on the guide assembly 50, the upper rollers 64 are loosely disposed between the flanges of the upper guide rail 51 for rolling contact therewith, the lower rollers 65 are loosely disposed between the flanges of the lower guide rail 52 for rolling contact therewith, and the middle rollers 66 rest atop the horizontal upper surface of one of the flanges of the lower guide rail 52 for rolling contact therewith. In this manner, the guide assembly 50 supports the weight of the carriage assembly 60 which are enabling the carriage assembly 60 to smoothly travel along the guide assembly 50 in the widthwise direction of the lift truck 10.

The carriage assembly 60 also includes structure for supporting the arm assembly 80. In the present embodiment, the support structure comprises a mounting bracket including a pair of vertical side plates 67 mounted atop the front plate 61 of the carriage assembly 60 and a vertical end plate 68 extending between the side plates 67. As shown in FIG. 5, a pair of aligned holes 69 for receiving a pivot pin for pivotably supporting the arm assembly 80 is formed in the side plates 67.

The carriage assembly 60 may be manually movable along the guide assembly 50 in the widthwise direction of the lift truck 10, or the manipulator 40 may include a powered drive mechanism for moving the carriage assembly 60 along the guide assembly 50. A drive mechanism may be mounted either on the guide assembly 50 or on the carriage assembly 60. The present embodiment includes a chain and sprocket drive mechanism mounted on the guide assembly 50. As best shown in FIGS. 3 and 4, a drive sprocket 54 is secured to the output shaft of a reversible motor 55 (which may be hydraulic or electric, for example) mounted on one of the vertical connecting plates 53 at one end of the guide assembly 50, and a driven sprocket 56 is rotatably mounted on one of the vertical connecting plates 53 at the opposite end of the guide assembly 50. A chain 57 passes around both sprockets 54 and 56, with each end of the chain 57 secured to an externally threaded chain anchor 70 mounted on a mounting plate 71 (shown in FIGS. 5 and 6) secured to the back side of the front plate 61 of the carriage assembly 60. The lengthwise position of one or both chain anchors 70 with respect to the mounting plate 71 can be adjusted to enable the tension in the chain 57 to be adjusted. By operating the motor 55 to rotate in the forward or reverse direction, the carriage assembly 60 can be moved in either direction along the length of the guide assembly 50. A controller for the motor 55 is preferably provided on board the lift truck 10 where it can be easily operated by the operator of the lift truck 10. A wide variety of other types of drive mechanisms can be used to translate the carriage assembly 60 along the guide assembly 50, such as hydraulic or pneumatic cylinders, a linear electric motor mounted on the guide assembly 50 or the carriage assembly 60, a rack and pinion system, or a belt and pulley system. The exact structure of a drive mechanism for the carriage assembly 60 is not important to the operation of the present invention.

Figure 10:
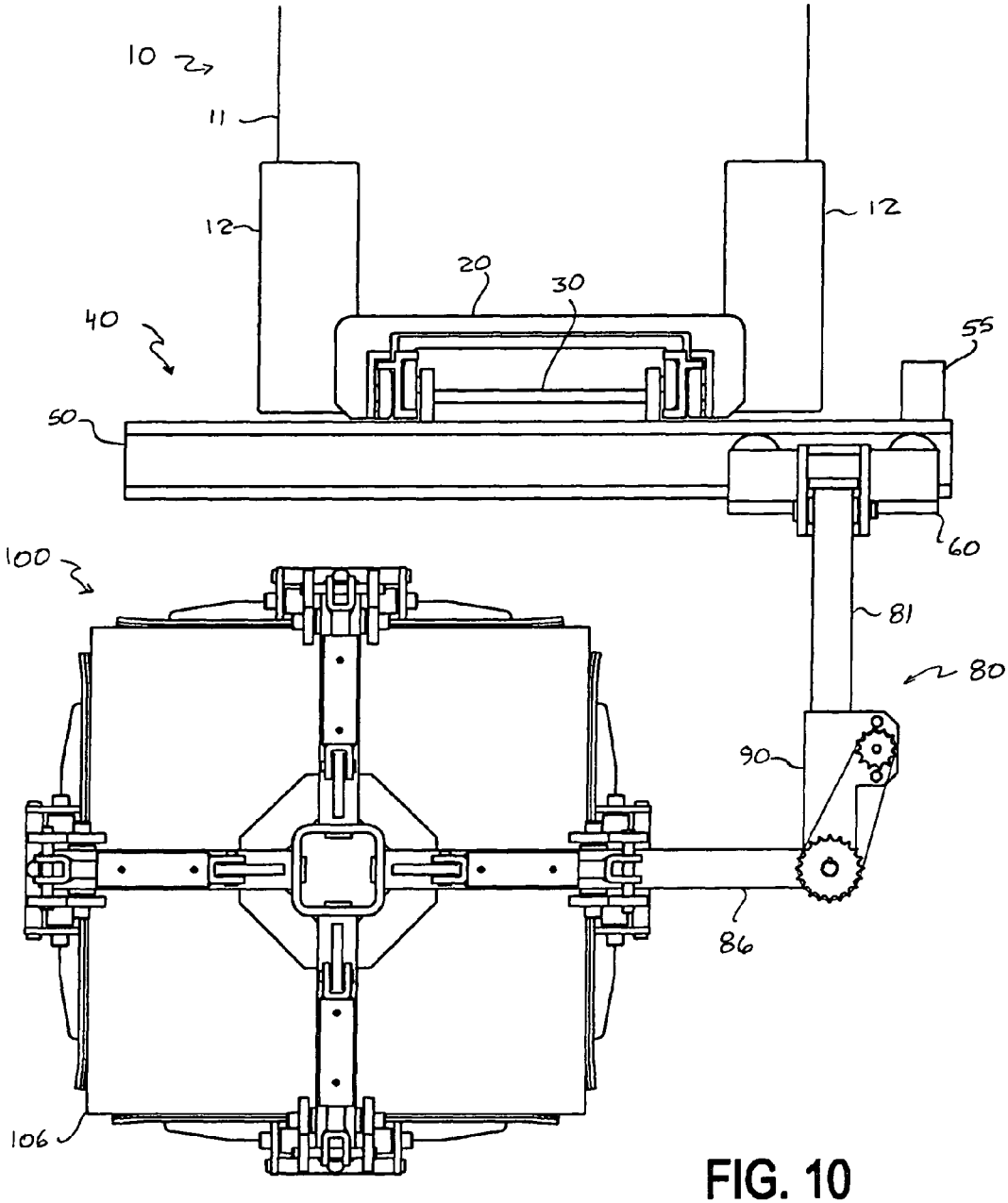
FIG. 10 is a schematic plan view of the manipulator of FIG. 1 when the carriage assembly has been moved to the right end of the guide assembly in the figure.
Figure 11:
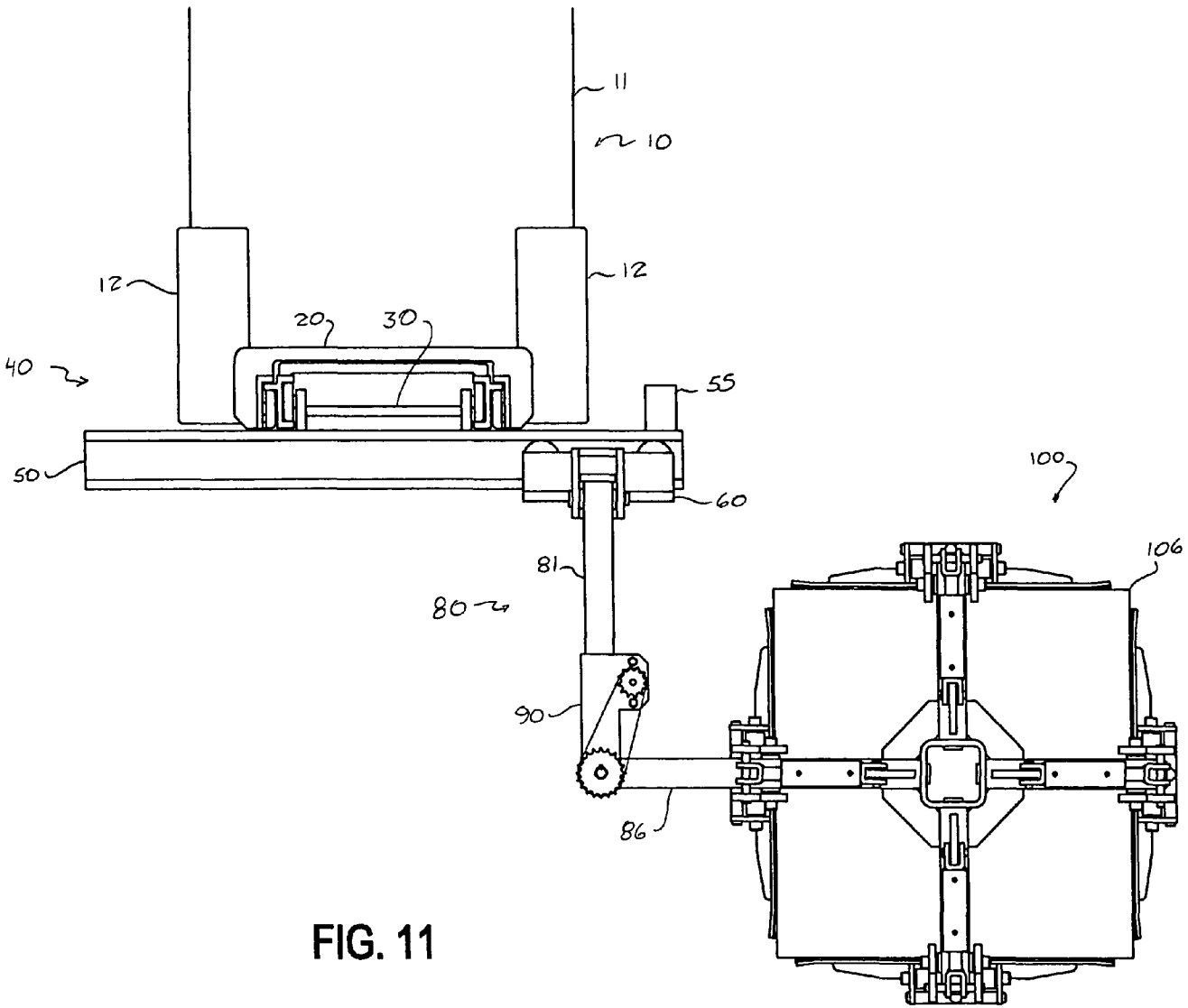
FIG. 11 is a schematic plan view of the manipulator of FIG. 11 in the state in which the second arm of the arm assembly has been rotated by 180° from its position in FIG. 10 so that the clamping apparatus is located to a widthwise side of the lift truck.

The arm assembly 80 holds the clamping apparatus 100 at a sufficient distance from the front of the lift truck 10 that the clamping apparatus 100 can pass in front of the lift truck 10 in the widthwise direction thereof between a position in which the clamping apparatus 100 does not overlap the guide assembly 50 in the widthwise direction of the lift truck 10 (such as the position shown in FIG. 1) and a position in which the clamping apparatus 100 overlaps the guide assembly 50 in the widthwise direction of the lift truck 10 (such as the position shown in FIG. 10) so as to enable a load to be inserted into or withdrawn from a space located to a widthwise side of the lift truck 10 while traveling along a straight path. In addition, the arm assembly 80 is preferably capable of swinging the clamping apparatus 100 about a substantially vertical axis by approximately 180° to enable a load held by the clamping apparatus 100 to be inserted into or withdrawn from a space on either widthwise side of the lift truck 10. However, a smaller or larger range of swinging movement of the clamping apparatus 100 by the arm assembly 80 about a substantially vertical axis is also possible, depending upon the extent to which it is desired to manipulate a load held by the clamping apparatus 100.

In the present embodiment, the arm assembly 80 includes a first arm 81 having one end connected to the carriage assembly 60, a second arm 86 having one end connected to the clamping apparatus 100 or other attachment being supported by the manipulator 40, and a joint 90 rotatably connecting the other ends of the two arms 81 and 86 to each other to enable the second arm 86 to rotate by 180° about a substantially vertically axis with respect to the first arm 81. The illustrated first arm 81 comprises a tube having a rectangular cross section. A first end of the first arm 81 is pivotably mounted on the mounting bracket of the carriage assembly 60 by a pivot pin 82 which passes through a pair of aligned holes formed in the first arm 81 near its first end and through the pair of holes 69 in the side plates 67 of the mounting bracket. A plate 83 is secured to the first end of the first arm 81, and one or more bolts 84 are screwed into the plate 83 with the head of each bolt 84 opposing the end plate 68 of the mounting bracket. The weight of the arm assembly 80 exerts a moment on the first arm 81 about the pivot pin 82 to make the heads of the bolts 84 abut against the end plate 68 to limit the rotational movement of the first arm 81 about the pivot pin 82. The length by which the bolts 84 are screwed into plate 83 can be adjusted by screwing the bolts 84 into or out of plate 83 to vary the angle of the first arm 81 with respect to the horizontal when the first arm 81 is in the position shown in FIG. 7.

The illustrated second arm 86 likewise comprises a tube with a rectangular cross section. The second arm 86 may be detachably connected to the clamping apparatus 100 to enable the manipulator 40 to be employed with different types of equipment. Alternatively, the second arm 86 may be permanently attached to the clamping apparatus 100. For example, in this embodiment, the second arm 86 is integral with one of the legs 102 of the clamping apparatus 100.

Figure 9:
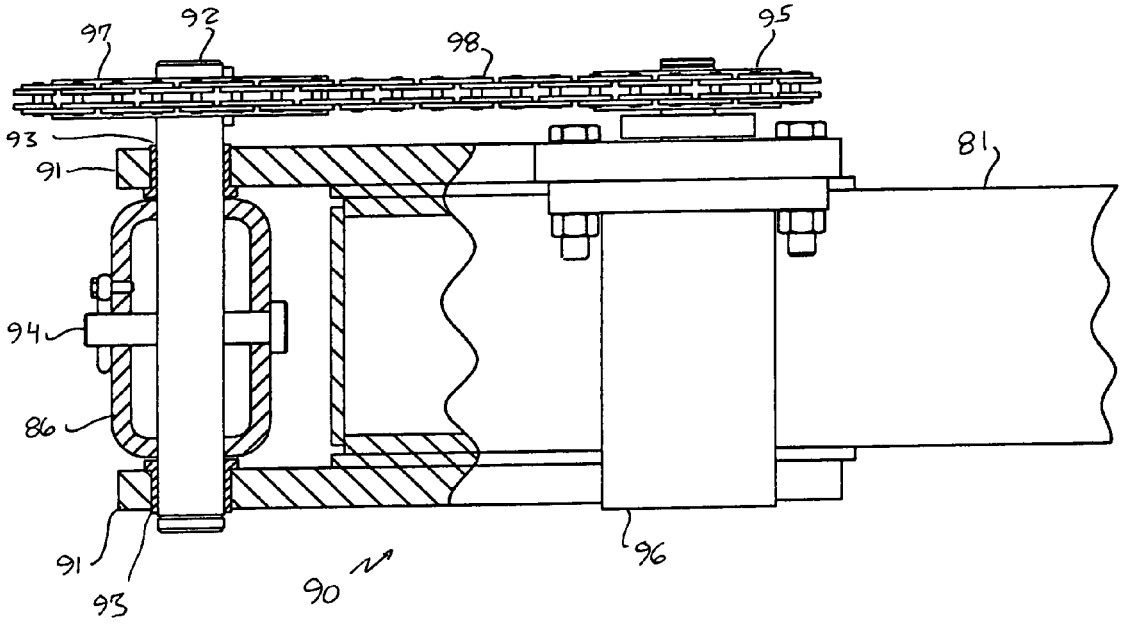
FIG. 9 is a schematic cross-sectional elevation taken along line 9-9 of FIG. 1 showing the structure of the joint of the arm assembly.

The joint 90 can have any structure which enables the first arm 81 to support the second arm 86 while enabling the second arm 86 to rotate, preferably by at least approximately 180°, with respect to the first arm 81 about a substantially vertical axis. As best shown in FIG. 9, the illustrated joint 90 includes a pair of horizontal mounting plates 91 secured to the top and bottom surfaces of the end of the first arm 81. The inner end of the second arm 86 is sandwiched between the mounting plates 91, and a pivot pin 92 which is journalled by bearings 93 in the mounting plates 91 passes through aligned holes in the mounting plates 91 and in the top and bottom sides of the second arm 86. The second arm 86 is prevented from rotating with respect to the pivot pin 92 by a retaining pin 94 which passes horizontally through holes in the second arm 86 and through a hole in the pivot pin 92. The pivot pin 92 is preferably removable to enable the second arm 86 and the clamping apparatus 100 to be disconnected from the joint 90.

The second arm 86 may be manually rotatable with respect to the first arm 81, or the manipulator 40 may include a drive mechanism to enable the operator of the lift truck 10 to rotate the second arm 86 about the first arm 81 by remote control. In the present embodiment, the arm assembly 80 includes a sprocket and chain drive mechanism including a drive sprocket 95 secured to the output shaft of a reversible motor 96 (which may be hydraulic or electric, for example) secured to the upper mounting plate 91 of the joint 90, a driven sprocket 97 secured to the pivot pin 92 for the second arm 86, and a chain 98 passing around both sprockets 95 and 97. The motor 96 can be controlled by the operator of the lift truck 10 to rotate the second arm 86 in either rotational direction with respect to the first arm 81. The motor 96 will typically be controlled by a controller on board the lift truck 10 where it can be readily operated by the operator of the lift truck 10.

The length of the first arm 81 is preferably such that the distance from the rotational center of the joint 90 (pivot pin 92) to the front surface of the guide assembly 50 is at least one-half the maximum outer dimensions of the clamping apparatus 100 measured in the fore-and-aft direction of the lift truck 10 so that when the second arm 86 is at right angles to the first arm 81 as shown in FIG. 1, the clamping apparatus 100 can pass in front of the lift truck 10 in the widthwise direction thereof without striking the guide assembly 50. There is no upper limit on the length of the first arm 81. The length of the second arm 86 can be selected based on the environment in which the lift truck 10 is to operate.

The hydraulic cylinders 105 of the clamping apparatus 100 and motors 55 and 96 (when they are hydraulic motors) may be driven by an unillustrated hydraulic power supply on the lift truck 10 through unillustrated hydraulic lines supported by the manipulator 40. When electric motors are used, the motors may be powered by a battery or generator in a suitable location, such as on board the lift truck 10.

Each of the arms 81 and 86 in this embodiment has a constant length, but it is also possible for one or both arms to have a variable length. For example, either arm may be telescoping.

Figure 12A:
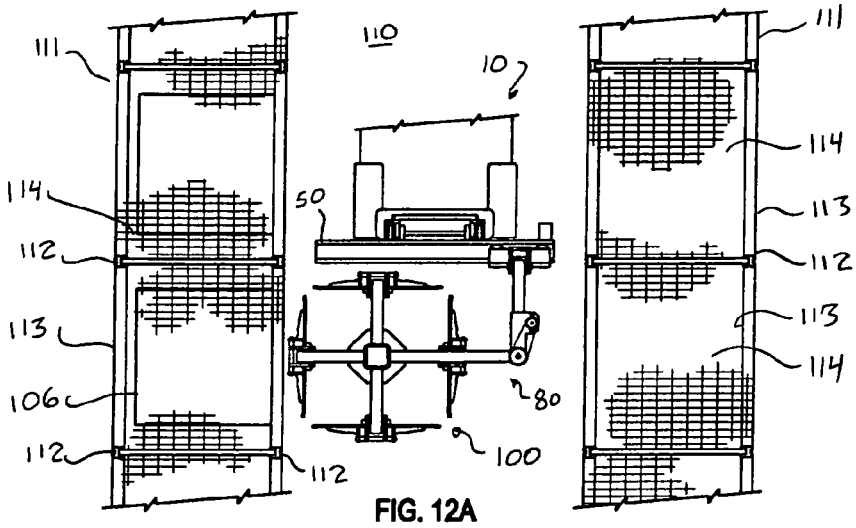
FIGS. 12A-12I are schematic plan views of the manipulator of FIG. 1 in different states as it transfers a load between opposite widthwise sides of a lift truck.
Figure 12B:
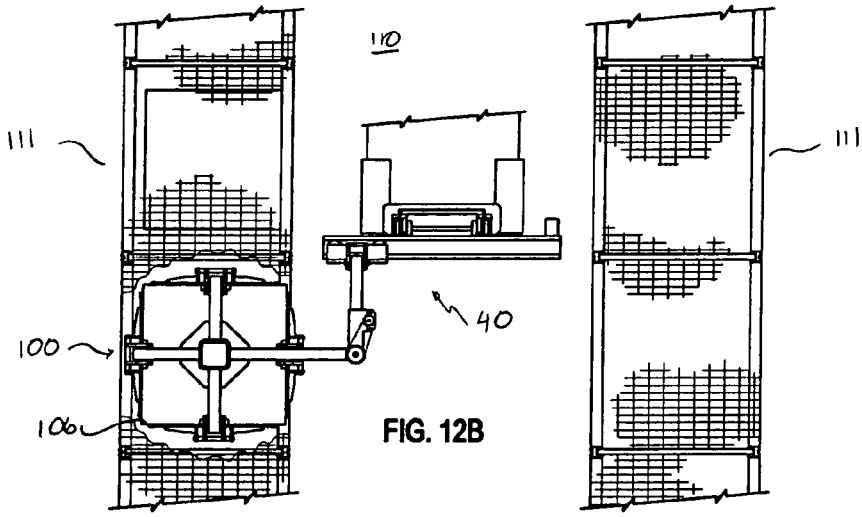
Figure 12C:
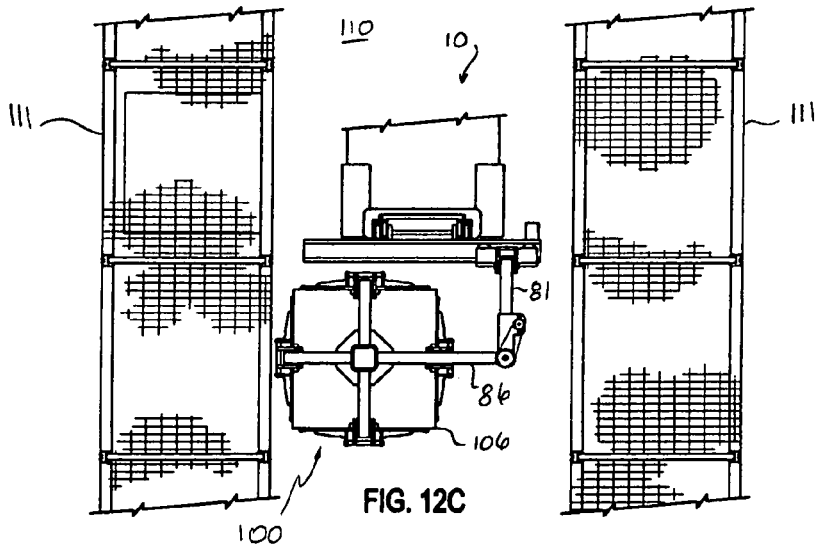
Figure 12D:
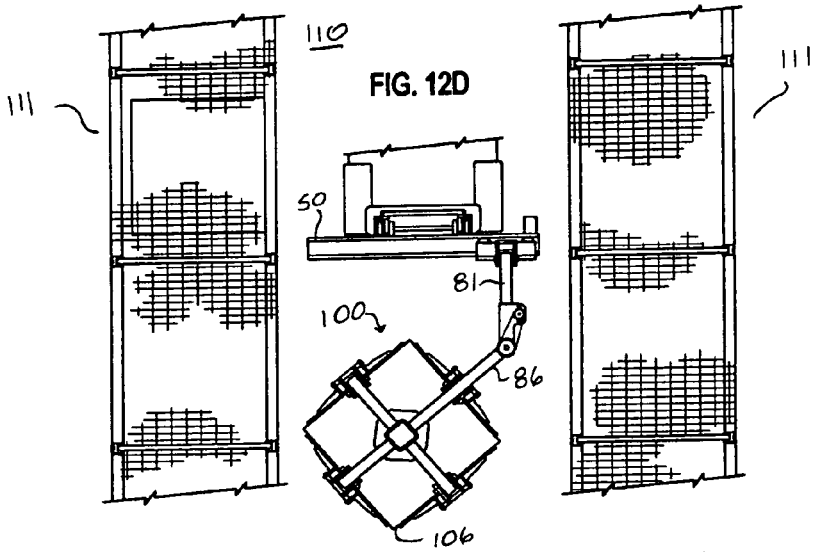
Figure 12E:
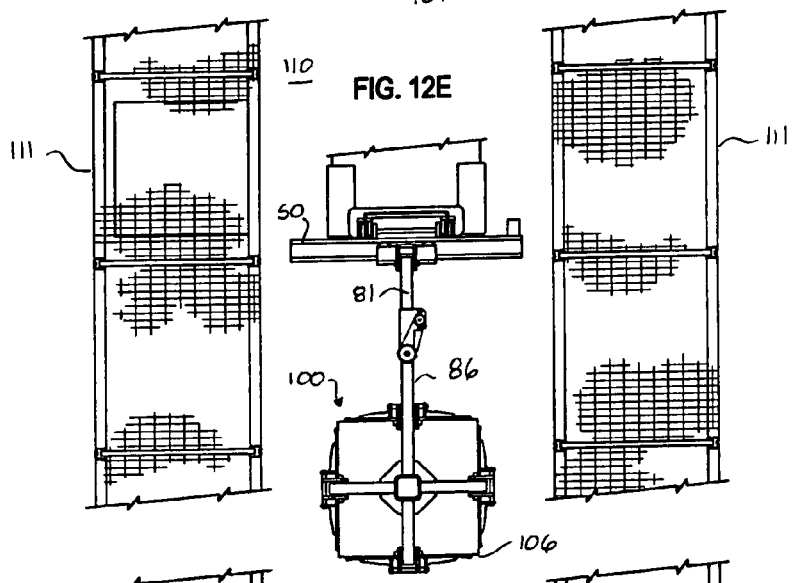
Figure 12F:
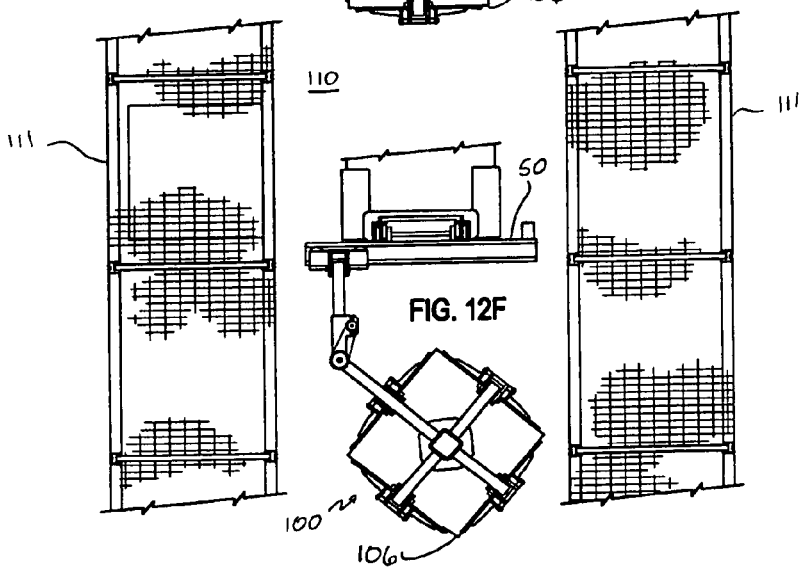
Figure 12G:
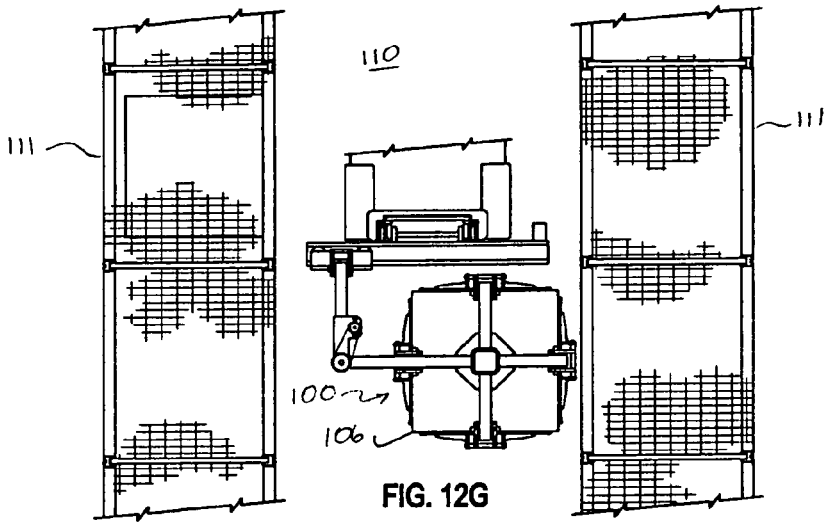
Figure 12H:
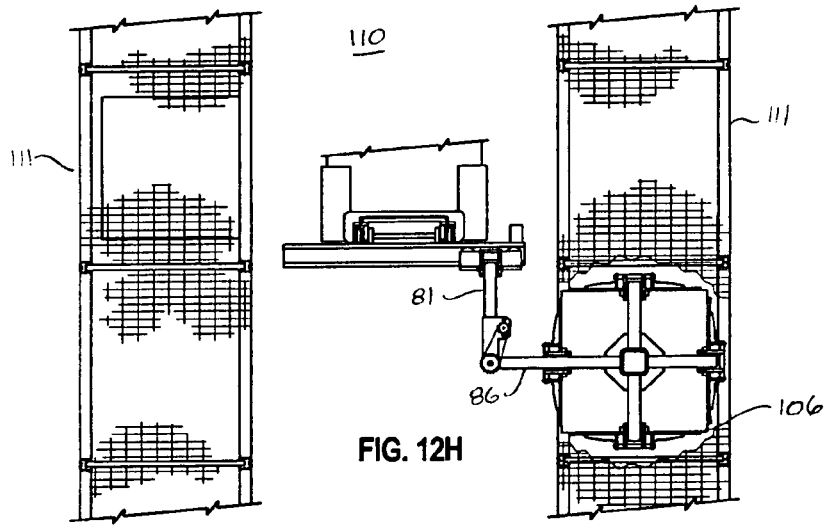
Figure 12I:
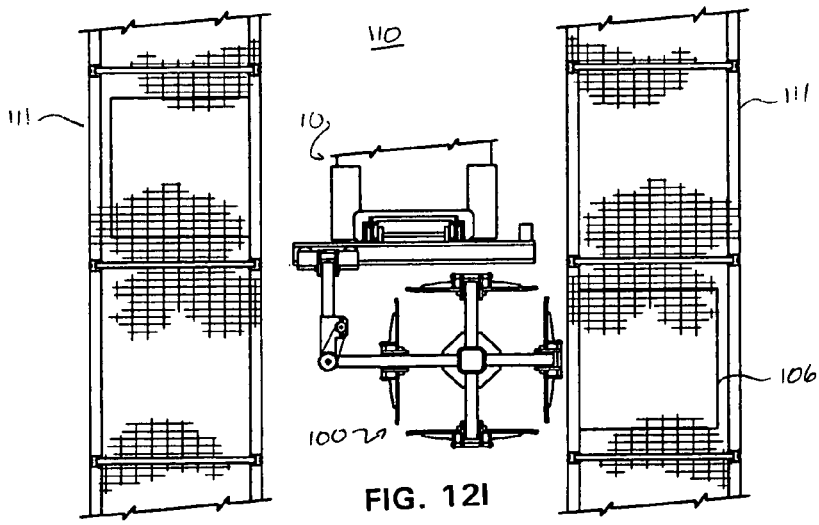

A situation in which a manipulator 40 according to the present invention can be used highly advantageously is for operation in a narrow aisle between rows of storage racks such as are frequently found in warehouses and distribution facilities. FIGS. 12A-12I are schematic plan views which illustrate the embodiment of FIG. 1 at different points during the process of transferring a load 106 from a storage rack 111 on one side of an aisle 110 and another storage rack 111 on the opposite side of the aisle 110. Each storage rack 111 typically comprises a plurality of vertical posts 112 arranged in parallel rows, horizontal support beams 113 secured to the posts 112, and a plurality of layers of shelves 114 (made of heavy-duty wire mesh in this example) supported by the beams 113. Each of the racks 111 shown in FIGS. 12A-12I has an upper and lower layer of shelves 114, but the number of layers is not important to the operation of the present invention. As shown in FIG. 12A, the lift truck 10 is first moved along the aisle 110 to a position at which the clamping apparatus 100 is aligned with a storage space containing a load 106 which is to be transported. At this point, the center of rotation of the joint 90 of the arm assembly 80 is positioned opposite the center of the load 106. As shown in FIG. 12B, the carriage assembly 60 is then moved along the guide assembly 50 in the widthwise direction of the lift truck 10 while passing between adjoining support posts 112 of the rack 111 until the clamping apparatus 100 is positioned above the load 106. The arms 103 of the clamping apparatus 100 are then pivoted towards the sides of the load 106 to grasp the load 106. In FIG. 12B, the shelf 114 located immediately above the load 106 in the upper layer of shelves 114 has been cut away to better show the load 106. As shown in FIG. 12C, the load 106 is then lifted up by raising the lift truck carriage 30 along the mast 20 to raise the load 106 off the shelf 114 on which it was sitting, and the clamping apparatus 100 and the load 106 are withdrawn from the storage rack 111 by moving the carriage assembly 60 in a straight line along the guide assembly 50 to the right in the figure until the clamping apparatus 100 and the load 106 are disposed inside the aisle 110 and clear of the edge of the storage rack 111. The lift truck 10 is then ready to travel along the aisle 110 to another storage space into which the load 106 is to be inserted. At any time, either before, during, or after movement of the lift truck 10 along the aisle 110, the second arm 86 can be rotated by 180° with respect to the first arm 81 as shown in FIGS. 12D-12G until the second arm 86 extends in the widthwise direction of the lift truck 10 in the opposite direction from in FIG. 12C. If the aisle 110 is too narrow for the second arm 86 and the clamping apparatus 100 to be rotated by 180° about the joint 90 with the carriage assembly 60 located at a single position along the guide assembly 50, the carriage assembly 60 can be translated along the guide assembly 50 as the second arm 86 is being rotated by simultaneous operation of the drive mechanism for the carriage assembly 60 and the drive mechanism for the joint 90 of the arm assembly 80 to reduce the extent to which the clamping apparatus 100 and the load 106 extend past the ends of the guide assembly 50 in the widthwise direction of the lift truck 10. For example, in FIGS. 12D-12F, the carriage assembly 60 is shifted to the left in the figures along the guide assembly 50 as the second arm 86 is being rotated in the counterclockwise direction with respect to the first arm 81. In this manner, the clamping apparatus 100 and the load 106 are prevented from extending outside the aisle 110 and striking the racks 111 or any merchandise stacked on the racks 111. When the load 106 is aligned with an empty storage space in one of the racks 111 into which the load 106 is to be placed, the carriage assembly 60 is moved in a straight line along the guide assembly 50 to the right as shown in FIG. 12H (in which the shelf 114 immediately above the load 106 in the upper layer of shelves 114 has been cut away for clarity) between adjoining support posts 112 of the rack 111 until the load 106 is positioned in the storage space. The load 106 is then lowered onto a shelf 114 inside the storage space, the clamping apparatus 100 releases the load 106 and is raised above the load 106, and then the carriage assembly 60 is moved along the guide assembly 50 to the left in the figures to the state shown in FIG. 12I to withdraw the clamping apparatus 100 from the storage space. The lift truck 10 is now ready to move to a new location along the aisle 110.

In order to keep the lift truck 10 at a suitable distance from the sides of the aisle 110 without the operator having to steer the lift truck 10, the lift truck 10 may be equipped with a guide system. For example, guide rollers may be provided on the body 11 of the lift truck 10 for rolling engagement with a guide rail mounted on the floor of the aisle 110, as described in U.S. Pat. No. 6,477,964, entitled "Guide System for a Forklift".

A manipulator according to the present invention can be employed in a manner similar to that described above on a lift truck operating alongside a row of pallets containing stacks or merchandise or in an aisle between two such rows of pallets. A clamping apparatus supported by the manipulator can be moved in a straight line in the widthwise direction of the lift truck to remove a load from or place a load onto one of the pallets in the row(s) without disturbing merchandise on adjoining pallets even when there is very little clearance between adjoining pallets. In addition, the clamping apparatus can be swung between opposite sides of an aisle to enable the clamping apparatus to access pallets on either side of the aisle.

Yet another situation in which a manipulator according to the present invention can be advantageously employed is to transfer a load from one pallet to another. Such a situation may occur when a manufacturer ships merchandise to a warehouse on pallets, and the manufacturer wishes to have his pallets returned to him rather than going into the distribution system from the warehouse. In this situation, the warehouse operator needs to transfer the merchandise from the pallets of the manufacturer to his own pallets. Transfer between two pallets can be carried out as follows. With two pallets placed side by side and the lift truck 10 positioned in front of the two pallets, the clamping apparatus 100 can be positioned by the manipulator 40 above a load on one of the pallets. The load can be grasped and lifted by the clamping apparatus 100, and the carriage assembly 60 of the manipulator 40 can be moved along the guide assembly 50 until the load is positioned above the second pallet. The clamping apparatus 100 can then be lowered until the load rests atop the second pallet, and the load can be released by the clamping apparatus 100. If the center-to-center distance between the two pallets is less than the maximum distance of which the carriage assembly 60 is capable of traveling along the guide assembly 50, the transfer of the load between the pallets can be accomplished while maintaining a constant angle between the arms 81 and 86 of the arm assembly 80. For example, the arms can be maintained at right angles to each other or aligned with each other during the transfer process.

A suitable range of movement of the carriage assembly 60 along the guide assembly 50 will vary with the application for which the manipulator 40 is employed. When the manipulator 40 is being used to transfer a load between two pallets in the manner just described, the range of movement of which the manipulator 40 needs to be capable is at least the center-to-center distance between the pallets. If two standard pallets, each measuring 40×48 inches, are placed side by side with no separation between them and with their longer sides (the 48-inch sides) opposing each other, the center-to-center distance between the pallets is 40 inches, so a suitable range of movement of the carriage assembly 60 in this situation is at least 40 inches. In order to allow some separation between adjoining pallets, a more suitable range of movement is somewhat larger than 40 inches, such as approximately 45 inches. If the two pallets are disposed with no separation between them and with their shorter sides (the 40-inch sides) opposing each other, the center-to-center distance between the pallets is 48 inches, so in this case a suitable range of movement of the carriage assembly 60 is at least 48 inches and preferably somewhat larger than this to permit some separation between the pallets.

When the manipulator 40 is being used to transfer a load to or from atop a shelf 114 on a rack 111 in the manner shown in FIGS. 12A-12I, the minimum range of movement of which the carriage assembly 60 needs to be capable is a range sufficient to enable the clamping apparatus 100 to be moved between a position in which it is positioned above a load 106 on the rack 111 and a position in which the clamping apparatus 100 is disposed inside the aisle 110 alongside the rack 111 and spaced far enough from the edge of the rack 111 to enable the lift truck 10 to travel down the aisle 110 without the clamping apparatus 100 striking the rack 111. This range of movement is given by the formula $$\text{minimum range of movement}=A+B$$

wherein

A is the distance from the edge of the rack adjoining the aisle to the center of the load disposed on the rack, and B is the distance from the edge of the rack adjoining the aisle to the center of the clamping apparatus when the clamping apparatus is located inside the aisle and spaced from the edge of the rack by a sufficient clearance to enable the lift truck to travel along the aisle When a load is disposed on a rack, the load will typically be sitting atop the center of a pallet. In this case, distance A is the distance from the edge of the rack to the center of the pallet. If the pallet is a standard pallet measuring 40×48 inches, distance A is 20 inches when one of the 48-inch sides of the pallet is flush with the edge of the rack.

Figure 8:
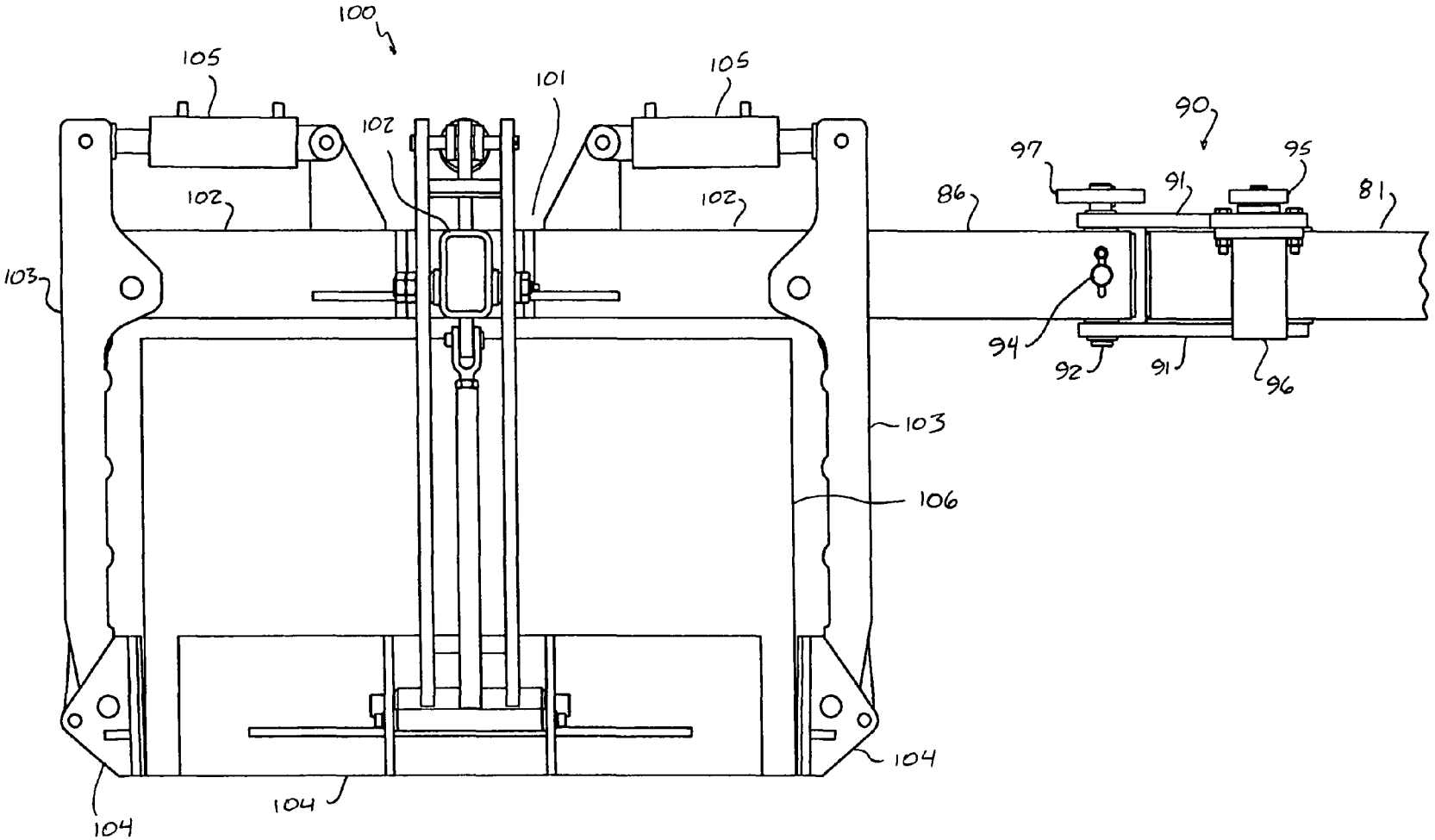
FIG. 8 is a schematic elevation of the clamping apparatus of FIG. 1 and the outer end of the arm assembly in a state in which the first and second arms of the arm assembly are aligned with each other.

Distance B will depend upon the design and the size of the clamping apparatus. For a clamping apparatus like that shown in FIG. 8, the maximum width of the clamping apparatus 100 measured to the outer sides of the clamping arms 103 when they are opened to their maximum extent is roughly 15 inches greater than the width of the largest load that the clamping apparatus 100 is designed to grasp. For a clamping apparatus 100 designed to handle a load with a width of 40 inches, the maximum width of the clamping apparatus 100 is equal to approximately 40+15=55 inches. Assuming that such a clamping apparatus 100 is disposed in an aisle 110 alongside a rack 111 with the clamping arms 103 opened to their maximum extent and with the clamping arm 103 which is closest to the rack 111 spaced from the edge of the rack 111 by a clearance of approximately 0.5 inches, then the distance B from the edge of the rack 111 to the center of the clamping apparatus 100 is 55/2+0.5=28 inches.

In this case, the minimum range of movement given by the above formula becomes 20+28=48 inches. In order to enable the edge of the pallet to be offset with respect to the rack 111 and to enable a larger clearance between the clamping apparatus 100 and the edge of the rack 111, a more suitable minimum range of travel is somewhat larger, such as approximately 50 inches. The minimum range of movement would be the same as this for the case in which a load measuring 40 inches wide is being placed onto or removed from a pallet in a row of pallets.

The values given by the above calculations are merely examples of a minimum range of movement for the carriage assembly 60 along the guide assembly 50, and the minimum range of movement can be larger or smaller than this value, depending upon the size of the load, the design of the clamping apparatus, the size of a pallet on which the load is sitting, how far the pallet is offset from the edge of a rack, and other factors. However, since a load measuring a maximum of 40 inches wide in the widthwise direction of a lift truck is fairly common, a minimum range of movement of approximately 50 inches enables the manipulator 40 to be widely employed for handling loads disposed on racks or on rows of pallets.

If the second arm 86 of the arm assembly 80 has an adjustable length, the carriage assembly 60 can be moved along the guide assembly 50 by a lesser distance than that given by the above formula, and the second arm 86 can be lengthened so that the total distance of travel of the clamping apparatus 100 due to the movement of the carriage assembly 60 along the guide assembly 50 and the lengthening of the second arm 86 equals the range of travel given by the above formula.

As can be seen from the above description, the ability of the carriage assembly 60 to be moved along the guide assembly 50 enables the clamping apparatus 100 to be moved along a straight line in the widthwise direction of the lift truck 10 and thereby enables the clamping apparatus 100 to be inserted into or withdrawn from a narrow space located to a widthwise side of the lift truck 10. In addition, the ability of the second arm 86 to rotate with respect to the first arm 81 combined with the ability of the carriage assembly 60 to be moved along the guide assembly 50 in the widthwise direction of the lift truck 10 enables the orientation of a load 106 to be changed within a very narrow space. These abilities give the manipulator 40 excellent versatility when operated in confined areas.

What is claimed is:

1. A manipulator for manipulating a lift truck attachment comprising:

a guide assembly adapted for mounting on a mast of a lift truck and having first and second parallel rails extending horizontally in a widthwise direction of the lift truck when the guide assembly is mounted on the mast of the lift truck;

a carriage assembly supported by the guide assembly for movement along the guide assembly in a lengthwise direction of the guide assembly and including rollers engaging with the rails of the guide assembly;

a chain drive for moving the carriage assembly along the guide assembly including a chain supported by the guide assembly and connected to the carriage assembly, and a drive motor mounted on the guide assembly and drivingly connected to the chain;

an arm assembly having a first arm connected to the carriage assembly and extending from the carriage assembly in a fore-and-aft direction of the lift truck when the guide assembly is mounted on the mast of the lift truck, a second arm connectable to the lift truck attachment a joint rotatably connecting the second arm to the first arm, and a drive mechanism located at the joint for rotating the second arm about the joint with respect to the first arm and comprising a horizontally coplanar drive sprocket and driven sprocket connected by a chain, the first arm maintaining a constant height as the carriage assembly moves along the rails of the guide assembly, the second arm being rotatable by the drive mechanism with respect to the first arm by approximately 180° by rotation of the sprockets between a first position in which the second arm is substantially perpendicular to the first arm and extends from the first arm in a first direction parallel to the lengthwise direction of the guide assembly and a second position in which the second arm is substantially perpendicular to the first arm and extends from the first arm in a second direction opposite to the first direction and parallel to the lengthwise direction of the guide assembly.

2. A lift truck arrangement comprising:

a lift truck having a mast;

a manipulator as claimed in claim 1 supported by the mast; and a lift truck attachment for engaging a load supported by the arm assembly of the manipulator.

3. A lift truck arrangement as claimed in claim 2 wherein the lift truck attachment comprises a clamping apparatus including a frame, a plurality of clamping arms mounted on the frame and movable with respect to the frame for grasping and releasing a load, and at least one actuator connected to one of the clamping arms to move the one of the clamping arms with respect to the frame.

4. A method of moving a load comprising:

grasping a load disposed on a first pallet with the lift truck attachment of the lift truck arrangement of claim 3;

raising the lift truck carriage to raise the load;

without moving the location of the mast, moving the carriage assembly along the guide assembly to move the load from a position above the first pallet to a position above a second pallet;

lowering the lift truck carriage to lower the load until it is supported by the second pallet; and releasing the load with the lift truck attachment.

5. A method as claimed in claim 4 including moving the carriage assembly along the guide assembly by at least 40 inches.

6. A method of operating a lift truck equipped with a manipulator as claimed in claim 1 comprising:

moving the carriage assembly of the manipulator of claim 1 along the guide assembly with the second arm perpendicular to the first arm of the arm assembly in the widthwise direction of the lift truck to position a clamping apparatus supported by the arm assembly above a load in a first position;

grasping the load with the clamping apparatus;

raising the clamping apparatus to raise the load;

rotating the second arm, while it supports the load, by approximately 180° with respect to the first arm to make the second arm perpendicular to the first arm;

moving the carriage assembly along the guide assembly to translate the load in the widthwise direction of the lift truck;

lowering the load onto a support surface in a second position spaced from the first position in the widthwise direction of the lift truck; and releasing the load with the clamping apparatus.

7. A method as claimed in claim 6 wherein the load does not overlap the guide assembly in the widthwise direction of the lift truck in at least one of the first and second positions.

8. A method as claimed in claim 6 wherein the first and second positions are on opposite widthwise sides of the lift truck.

9. A method as claimed in claim 6 wherein the load overlaps the guide assembly in the widthwise direction of the lift truck during at least a portion of the step of moving the carriage assembly along the guide assembly.

10. A method as claimed in claim 6 including moving the carriage assembly along the guide assembly in the widthwise direction of the lift truck while rotating the second arm with respect to the first arm.

11. A manipulator as claimed in claim 1 including a plurality of rollers disposed on a rear side of the guide assembly and engageable with channels of the mast of the lift truck to guide the manipulator along the mast.

12. A manipulator as claimed in claim 1 wherein the first arm is pivotably mounted on the carriage assembly for pivoting about a horizontal axis when the guide assembly is mounted on the mast of the lift truck, and the carriage assembly includes a mechanism for adjusting an angle of the first arm with respect to the horizontal about the horizontal axis.

13. A manipulator as claimed in claim 1 wherein the chain drive includes a pair of sprockets rotatably mounted on the guide assembly at first and second lengthwise ends of the guide assembly, the chain extends around the sprockets, and the motor is drivingly connected to one of the sprockets.

14. A manipulator as claimed in claim 1 wherein the rollers of the carriage assembly include a roller rolling along a top surface of the first rail and a roller rolling along a side surface of the first rail as the carriage assembly moves along the guide assembly.

15. A manipulator as claimed in claim 1 wherein the first rail forms a side surface of a downwardly-facing first channel extending in the lengthwise direction of the guide assembly, the second rail forms a side surface of an upwardly-facing second channel extending in the lengthwise direction of the guide assembly, and the rollers include a roller disposed inside the first channel and rollable along a side surface of the first rail as the carriage assembly moves along the guide assembly, a roller disposed outside of the first channel and rollable along a top surface of the first rail as the carriage assembly moves along the guide assembly, and a roller disposed inside the second channel and rollable along a side surface of the second rail as the carriage assembly moves along the guide assembly.

16. A manipulator as claimed in claim 1 including a lift truck carriage disposed on a rear side of the guide assembly and having a plurality of rollers for engagement with channels of the mast of the lift truck, the lift truck carriage and the guide assembly forming a single unit.

17. A manipulator as claimed in claim 1 wherein the carriage assembly is movable along the guide assembly by at least 40 inches in the lengthwise direction of the guide assembly.

18. A manipulator as claimed in claim 1 wherein the carriage assembly is movable along the guide assembly by at least 45 inches in the lengthwise direction of the guide assembly.

* * * * *